US010837280B2

(12) United States Patent
Rataj et al.

(10) Patent No.: US 10,837,280 B2
(45) Date of Patent: Nov. 17, 2020

(54) FRICTION BOLT

(71) Applicant: SANDVIK INTELLECTUAL PROPERTY AB, Sandviken (SE)

(72) Inventors: Mieczyslaw Rataj, Charlestown (AU); Peter Young, Queensland (AU); Bradley Darlington, Wellard (AU)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 16/445,733

(22) Filed: Jun. 19, 2019

(65) Prior Publication Data

US 2019/0316467 A1 Oct. 17, 2019

Related U.S. Application Data

(63) Continuation of application No. 15/779,536, filed on May 28, 2018, now Pat. No. 10,370,968.

(30) Foreign Application Priority Data

Nov. 30, 2015 (WO) ..... PCT/EP2015/078063

(51) Int. Cl.
*E21D 21/00* (2006.01)

(52) U.S. Cl.
CPC ..... *E21D 21/004* (2013.01); *E21D 21/006* (2016.01); *E21D 21/0033* (2013.01); *E21D 21/0086* (2013.01); *E21D 21/008* (2013.01)

(58) Field of Classification Search
CPC . E21D 21/0033; E21D 21/004; E21D 21/006; E21D 21/008; E21D 21/0093; E21D 21/0086
USPC ..... 405/259.3
See application file for complete search history.

(56) References Cited

U.S. PATENT DOCUMENTS 2,525,198 A * 10/1950 Beijl ..... E21D 21/008 411/26
3,693,359 A * 9/1972 Karara ..... E21D 21/008 405/259.3
3,797,254 A * 3/1974 Askey ..... E21D 21/00 405/259.3
4,112,813 A * 9/1978 Kuhlmann ..... F16B 13/045 411/49
4,312,604 A * 1/1982 Fu ..... E21D 21/0093 405/259.3
4,342,527 A * 8/1982 White ..... E21D 21/0093 405/259.3
4,519,735 A * 5/1985 Machtle ..... F16B 13/066 411/65

(Continued)

FOREIGN PATENT DOCUMENTS

AU 2012209052 A1 2/2013
CA 2916043 A1 * 2/2015 ..... E21D 21/02

(Continued)

*Primary Examiner* — Frederick L Lagman
(74) *Attorney, Agent, or Firm* — Corinne R. Gorski

(57) ABSTRACT

A friction bolt assembly to frictionally engage a bore formed in rock strata. The assembly includes an elongate tube and an expander mechanism acted on by an anchor mechanism via an elongate bar or cable. A retainer mechanism is mounted to act between the bar or cable and the tube to prevent ejection of the bar or cable from the assembly should the bar or cable break.

22 Claims, 8 Drawing Sheets

(56) References Cited

U.S. PATENT DOCUMENTS

| | | | | | |
|---|---|---|---|---|---|
| 4,789,284 | A * | 12/1988 | White | E21D 21/008 | 405/259.3 |
| 4,859,118 | A | 8/1989 | Schaeffer | | |
| 7,465,128 | B2 * | 12/2008 | Bruneau | E21D 21/0026 | 405/259.3 |
| 8,714,883 | B2 * | 5/2014 | Rataj | E21D 21/0033 | 405/259.3 |
| 9,797,249 | B2 * | 10/2017 | Rataj | E21D 21/004 | |
| 10,370,968 | B2 * | 8/2019 | Rataj | E21D 21/0086 | |
| 2012/0163924 | A1 * | 6/2012 | Rataj | E21D 21/0033 | 405/259.3 |
| 2013/0294844 | A1 * | 11/2013 | Cawood | E21D 21/004 | 405/259.3 |

FOREIGN PATENT DOCUMENTS

| | | | | |
|---|---|---|---|---|
| DE | 3505035 | C1 * | 3/1986 | E21D 21/0033 |
| WO | WO-8802437 | A1 * | 4/1988 | E21D 21/02 |
| WO | 2010104460 | A1 | 9/2010 | |
| WO | 2012053965 | A1 | 4/2012 | |
| WO | 2015189146 | A2 | 12/2015 | |

* cited by examiner

A - A

B - B

FRICTION BOLT

RELATED APPLICATION DATA

This application is a continuation of U.S. patent application Ser. No. 15/779,536 filed May 28, 2018, now U.S. Pat. No. 10,370,968, which is a § 371 National Stage Application of PCT International Application No. PCT/EP2016/078839 filed Nov. 25, 2016, claiming priority of PCT International Application No. PCT/EP2015/078063 filed Nov. 30, 2015.

TECHNICAL FIELD

The present invention relates to a friction bolt assembly for use in rock strata to stabilise the strata against fracture or collapse and in particular, although not exclusively, to a friction bolt configured to retain all components of the bolt within the assembly should parts of the bolt break in response to tensile and/or shear forces.

BACKGROUND

Expansion rock bolts are installed by drilling a bore into the rock strata, inserting the rock bolt into the bore and expanding the part of the bolt to provide a friction lock against the bore surface. Expansion rock bolts include an elongate tube, which is usually split longitudinally, with an expander mechanism positioned within the tube, normally towards the tube leading end that is inserted first into the drilled bore in the rock strata or wall. The expander mechanism is connected to a flexible cable or solid bar that extends to the trailing end of the bolt and attaches to an anchor such that expansion of the expansion mechanism is effected by pulling or rotating the cable or bar.

The bore that is drilled into the rock strata is intended to be of a smaller diameter than the outside diameter of the tube, so that the tube is already a friction fit within the bore prior to expansion of the bolt which maximises frictional engagement of the rock bolt with the bore wall. This method of insertion is relatively simple, in contrast with other forms of rock bolts that employ resin or grout to anchor the rock bolt within the bore. Example friction bolt assemblies that comprise a generally circular tube to accommodate an elongate friction bolt are described in WO 2010/104460; U.S. Pat. No. 4,859,118 and AU 2012-209052.

Resin anchored bolts typically have a resin cartridge that is required to be inserted into the bore prior to insertion of the bolt. Insertion of the resin cartridge is sometimes very difficult, because typically the tunnel walls extend to a significant height, so that access to bores into which the cartridge is to be inserted can be inconvenient. Additionally, the resin which is employed is relatively expensive and has a limited shelf life.

Cement grouted rock bolts are less expensive than resin anchored bolts, but application of the cement is more cumbersome than that of the resin. Cement grouting requires cement mixing equipment, as well as pumping and delivery equipment, to deliver the mixed cement into the bore.

Resin or cement anchored rock bolts generally anchor in a bore to provide greater levels of rock reinforcement or stabilisation compared to friction rock bolts, due to a better bond between the bore wall and the resin or cement, compared to the frictional engagement of a friction rock bolt. Also, cement anchored rock bolts typically enable a bond along the full length of the rock bolt and the bore wall. However, the advantages of speed of installation and cost make friction rock bolts attractive in suitable environments.

Any form of rock bolt is susceptible to fail if the bolt is exposed to excessive loading by the rock strata into which the bolt has been installed. Failure can be tensile or shear failure or it can be a combination of tensile and shear failure. In expansion rock bolts, the bolt can fail through fracture of the tube. Failure of that kind can often be tolerated provided the bar or cable of the bolt does not fail also. However, if the rock bolt is loaded to the extent that both the tube and the bar (or cable) both fail, then there is the potential that a section of the rock bolt that is towards the open end of the bore (the trailing end of the rock bolt) can eject from the bore with considerable momentum, posing a danger to workers and equipment within the immediate vicinity. The section of the rock bolt that can eject from the bore can include a portion of the tube and the bar or cable, the anchor mechanism (that attaches to the trailing end of the cable or bar) and the rock plate. Additionally, other accessories may be included in the ejected section. Accordingly, what is required is a friction bolt assembly that addresses these problems.

SUMMARY

It is an objective of the present invention to provide a friction bolt assembly configured to prevent ejection under load of at least a portion of the assembly and in particular a rearward end part of the assembly should portions of the assembly break. It is accordingly a specific objective to provide a friction bolt assembly that reduces safety risks to personnel and the likelihood of damage to equipment in close proximity to the rock bolt.

It is a further specific objective of the present invention to provide a rock bolt assembly that is configured to retain broken or fractured components of the assembly via one or a plurality of mechanisms that does not require a tube part of the assembly to be placed in axial tension during use which may otherwise result in the tube fracturing or rupturing and being ejected from the rock strata bore in use. It is therefore a specific objective to provide a rock bolt assembly in which the only components that are placed under tensile load include the bar or cable extending axially within the rock bolt assembly.

It is a further objective to provide a retaining mechanism to retain broken or fractured components of the rock bolt assembly that functions independently of and is therefore not reliant on the rock strata as a component part of the retainer assembly. It is a specific objective to provide a rock bolt assembly having a retainer mechanism that is self-reliant and functioning that obviates the need for cooperation with the rock strata surrounding the friction bolt assembly. Such an arrangement is adapted to provide a reliable retaining action for any components of the assembly that may fracture or separate due to breakage under tensile and/or shear load.

It is a further objective to provide a rock bolt assembly that when in use and in particular immediately following initial installation, distributes the loading forces axially along the length of the assembly. In particular, it is a specific objective to reduce tensile forces within the bar via distribution of the initial tensile loading of the bar to eliminate or reduce axial elongation of the bar and hence to maintain the effectiveness of the assembly to stabilise strata against fracture or collapse.

The objectives are achieved, in part, by a retainer mechanism acting between a tube part of the assembly and a bar or cable part of the assembly. The objectives are also achieved, in part, by an anchor mechanism forming part of the rock bolt assembly that is configured to engage the rock strata that surrounds an open end of the bore into which the rock bolt is inserted and secured that does not place the tube in tension which would otherwise increase the susceptibility of the tube to crack, split or fail in response to movement of the rock strata surrounding the rock bolt.

Additionally, the objectives are achieved by providing a means for load transfer from the bar to the radially outer tube such that tensile forces within the bar can be distributed to (and shared with) the tube. Such an arrangement is advantageous to reduce the loading of specific regions of the assembly and effectively distribute the loading forces axially along the length of the assembly. This is achieved, in part, via a part of retainer mechanism that is positioned radially between the bar and the tube and at an axially rearward region of the bar and tube so as to be axially separated from a primary expander mechanism located at an axially forward end of the assembly.

According to a first aspect of the present invention there is provided a friction bolt assembly to frictionally engage an internal surface of a bore formed in rock strata, the assembly including: an elongate tube having a leading end and a trailing end; an expander mechanism located within the tube and towards or at the leading end and configured to apply a radial expansion force to the tube to secure the assembly to the rock strata; an elongate bar or cable extending longitudinally within the tube and connected at or towards a first end to the expander mechanism and at or towards a second end to an anchor mechanism positioned at or towards the trailing end of the tube; a retainer mechanism acting between the tube and the bar or cable such that at least a length portion of the bar or cable is prevented from the ejection from the assembly should the bar or cable break; the anchor mechanism including a fixing mountable at or towards the second end of the bar or cable and configured to brace against the trailing end of the tube that by adjustment creates tension in the bar or cable to act on the expander mechanism and create the radial expansion force; characterised in that: at least a part of the fixing projects radially outward beyond the tube or a component attached to an external region of the tube so as to be capable of being braced against the rock strata at a region around an external end of the bore.

The fixing may be a nut and a flange extending radially outward beyond the tube, the flange configured to be braced against the rock strata. Optionally, the nut and flange are formed non-integrally so as to be separate components relative one another and the elongate tube. Optionally, the nut is secured to the second end of the bar or cable such that rotation of the nut provides a corresponding rotation of the bar or cable. Optionally, according to further implementations, the nut is secured to a second end of the bar or cable via cooperating screw threads to allow the bar or cable to be moved axially via rotation of the nut.

The flange is formed as an annular washer capable of being axially trapped between the nut and the annular trailing end of the tube. Importantly, the flange, in the form of an annular gasket is not mechanically secured to the tube by weld, adhesive or other mechanical attachments and is demountable at the assembly exclusively via engagement by the nut with the bar or cable so as to brace the flange in position against the trailing end of the tube. Such an embodiment is advantageous to avoid tensile load being transmitted through the tube when the flange is loaded by an axial expansion force resultant from changes and shifting of the rock strata.

The flange and the nut may be formed non-integrally such that the nut is coupled directly to the bar or cable; and the flange is positioned axially between the nut and the trailing end of the tube. The flange includes an abutment surface extending radially outward from the tube and having at least a portion facing generally towards the leading end of the tube, the abutment surface capable of being engaged by a rock plate to extend radially outward from the flange and to brace against the rock strata at the region around the external end of the bore. Accordingly, a radially outer region of the flange is exposed and accessible for contact with a radially inner portion of an annular rock plate. According to some implementations, the flange may be dimensioned so as to sit directly against the rock surface surrounding the borehole to obviate the need for a separate rock plate. Optionally, the flange is annular in the form of a flat washer. Optionally, the flange may have regions that are bent, angled or curved to provide a profiled, non-planar flange.

Optionally, the region of the flange that projects radially outward beyond an external surface of the tube includes a radial length that is approximately equal to or greater than a distance by which the flange extends radially inward between the tube and the bar or cable. Optionally, a distance by which the flange extends radially outward from the tube is greater than half a radial thickness of the bar or cable. Optionally, the flange projects radially outward beyond a ring or collar secured to a radially outward facing surface of the tube such that the flange projects radially out and beyond the ring and is capable of contacting a radially inner portion of the rock plate. Such an arrangement is advantageous to prevent the tube being placed under tensile load as the rock bolt is secured and anchored within the bore.

Optionally, the retainer mechanism includes a sustainer attached at or towards the trailing end of the tube; and an engager provided at the bar or cable axially intermediate the sustainer and the first end of the bar or cable; wherein the engager is configured to engage radially the sustainer to prevent the ejection of the bar or cable from the assembly should the bar or cable break. The sustainer and the engager have portions configured to overlap radially to arrest the rearward movement of the rod or cable relative to the tube.

The retainer mechanism can have a restrainer positioned radially between the bar and an inner surface of the tube, and the engager is configured to engage radially the restrainer and the restrainer is configured to engage radially the sustainer to prevent the ejection of the bar or cable from the assembly should the bar or cable break. The restrainer is positioned radially and axially between the engager and the sustainer such that the axial retention of the rearward region of the bar or cable results from the radial and axial abutment and frictional contact between the engager, the restrainer and the sustainer.

Optionally, the restrainer is not rigidly mounted to the tube or the bar or cable and is held in position around the bar or cable exclusively via the close frictional fitting of the respective components. Accordingly, the restrainer is provided with a degree of axial movement relative to the tube and the bar or cable.

Optionally, the restrainer is a collar having a central bore to receive the bar or cable.

Optionally, the restrainer is formed as a single component that may be split longitudinally so as to allow the restrainer to expand and contract. According to further implementations, the restrainer may be formed as a two part component, the two parts being divided axially.

Optionally, the restrainer is divided circumferentially into two segments that may be independently inserted and removed at the tube interior so as to be centred and positioned around the bar or cable and against a radially inward facing surface of the tube. Such an arrangement facilitates initial assembly and installation of the friction bolt. Where the restrainer is formed as a single component, the restrainer may comprise at least one movable projection, tab, latch or lug.

Optionally, the restrainer includes a barb projecting radially outward beyond the tube to engage the sustainer mounted radially externally at the tube.

Optionally, the barb is formed integrally with the restrainer and is hingibly mounted at the main body of the restrainer so as to be capable of radial compression and expansion to extend beyond an outer surface of the tube or to be compressed to sit radially within the tube. Such an arrangement is advantageous to facilitate initial assembly of the retainer mechanism as part of the friction bolt.

Optionally, the restrainer may have a notch formed in a radially outward facing surface of the restrainer to receive radially at least a part of the sustainer.

Optionally, the restrainer may have a radially inward facing conical or tapered surface to be engaged by the engager. Accordingly, a radial thickness of the restrainer may decrease from a rearward end to a forward end. The conical or tapered surface of the restrainer is configured to provide an interference lock with the engager secured to a region of the bar or cable should the bar or cable break and the engager be forced axially and radially against the restrainer.

Optionally, the engager may include ribs projecting radially outward from the bar or cable. Optionally, the ribs may extend substantially over the majority of the length of the bar or cable. Optionally, a rearward portion of the bar or cable may be devoid of ribs and comprise a generally smooth cylindrical external surface. The bar may comprise a conventional ribbed or part-ribbed steel rebar as will be appreciated by those skilled in the art.

Advantageously, as the bar is placed under tension via the anchor mechanism, a ribbed section of the bar is displaced axially rearward such that the radially projecting ribs pass under the restrainer causing it to expand radially. This expansion increases the frictional contact between a radially external facing surface of the restrainer and an internal facing surface of the tube such that the tube will begin to share the load applied to the bar by the rock. Accordingly, a maximum load applied to the axially forward expander mechanism is reduced. This reduces the risk of failure of the expander mechanism (as the wedges are prevented from passing axially beyond one another). The additional load applied by the radial expansion of the restrainer (via the tube) is resisted by the friction between the external facing surface of the tube and the rock within which the assembly is embedded. This load distribution is beneficial at regions where the load applied by the rock significantly exceeds the strength of the bar. At such high load, the bar would otherwise elongate and reduce the effectiveness of the assembly to stabilise the strata against fracture or collapse. As the load is distributed to the tube via the axially rearward restrainer (via radial expansion resultant from contact with the bar ribbed section at a radially inner region of the restrainer) the likelihood (or magnitude) of bar elongation is reduced.

Optionally, the engager includes a wedge or ferrule attached to the bar or cable. The wedge includes a conical or tapered radially external facing surface so as to cooperate with a conical or tapered surface of the restrainer so as to provide an interference frictional fit between the engager and the restrainer. Such an arrangement is advantageous in that the strength of the frictional lock between the bar or cable and the restrainer is enhanced by the shape profile of the cooperating abutment surfaces of the engager and the restrainer.

Optionally, the sustainer includes a tab projecting radially inward from the tube. Optionally, the tube includes a split extending longitudinally so as to be capable of radial expansion and contraction. According to such implementations, the sustainer may be formed as a bridge tab extending and secured within the split so as to form a bridge. According to such embodiments, the rearward region of the tube extends continuously around the axis. Such an arrangement is advantageous to reinforce the tube at the trailing end.

Optionally, the sustainer is formed as a metal tab having a rearward half secured by weld to the tube and a forward half that is bent radially inward towards the bar or cable.

Optionally, the sustainer includes a band or ring attached to the tube and engageable radially with at least part of the engager or the restrainer.

Optionally, the band or ring may be attached to a radially inner surface or a radially outer surface of the tube. Where the sustainer includes a band or ring attached to an external surface of the tube, the restrainer includes a barb that projects radially outward beyond the tube wall so as to radially overlap onto the band or ring.

Optionally, the expander mechanism includes a first wedge mounted at the first end of the bar or cable and a second wedge secured to a radially inward facing surface of the tube. Optionally, the first wedge is mounted at the bar or cable by cooperating screw threads such that the first wedge is axially moveable along the bar or cable via rotation of the bar or cable within an internal bore of the first wedge. Such an arrangement includes a bar or cable having a fixing, and in particular a nut, rigidly mounted to a second end of the bar or cable.

Optionally, the first wedge may be non-movably mounted at the bar or cable such that the nut of the fixing is rotationally mounted at a second end of the bar or cable via cooperating screw threads.

Optionally, the expander mechanism may have one or a plurality of wedges attached to the bar or cable and one or a plurality of wedges attached to the tube.

The expander mechanism may be mounted internally within the tube and does not protrude from a leading end of the tube. Such an arrangement is advantageous for reliable installation of the friction bolt into the bore and to avoid unintentional misalignment or damage to the expander mechanism as the friction bolt is loaded into the bore via mechanical loading apparatus such a pneumatic or hydraulic percussion hammers.

The foregoing summary, as well as the following detailed description of the embodiments, will be better understood when read in conjunction with the appended drawings. It should be understood that the embodiments depicted are not limited to the precise arrangements and instrumentalities shown.

DETAILED DESCRIPTION

Figure 1A:
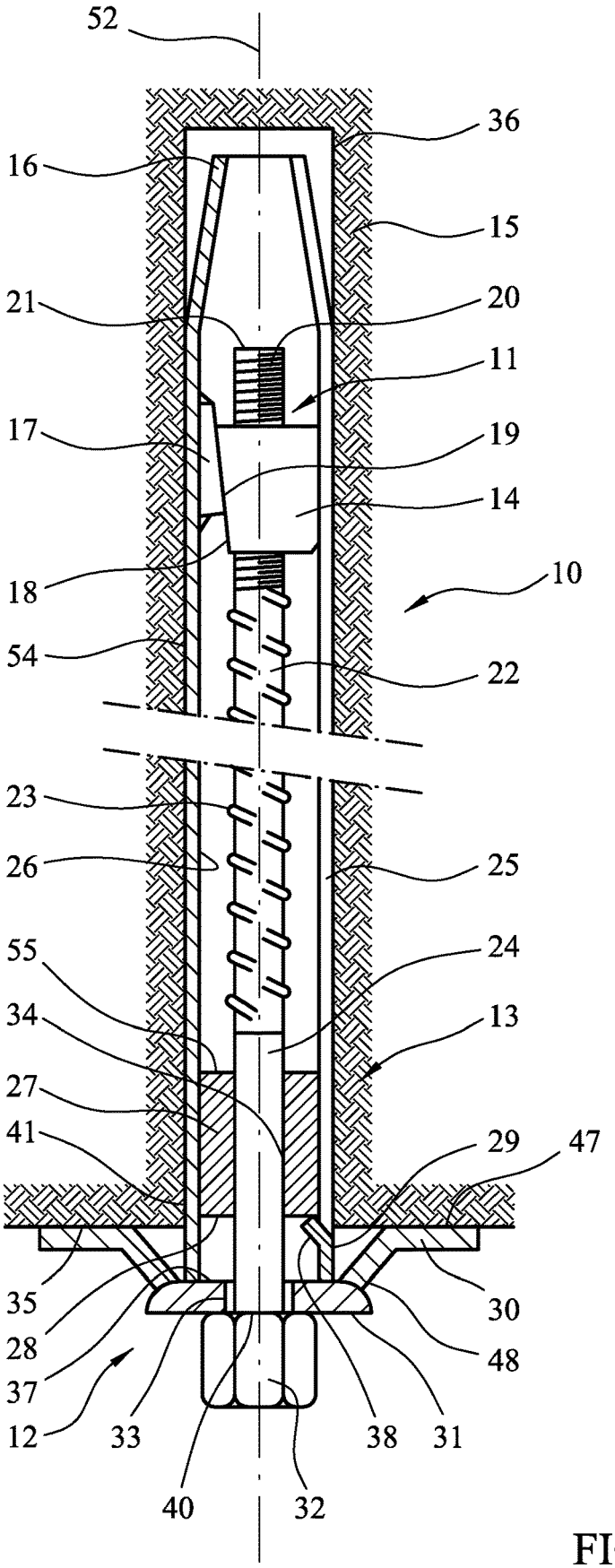
FIG. 1A is a partial cross-sectional view of a friction rock bolt assembly configured for anchored mounting within a bore formed in rock strata according to a specific implementation.

Referring to FIG. 1A, a friction rock bolt assembly 10 is configured for mounting and securement within a bore 36 extending within a rock strata 15. The friction bolt 10 is generally elongate being centred on longitudinal axis 52 and includes primarily an elongate tube 25 that is split axially; an expander mechanism indicated generally by reference 11; a retainer mechanism indicated generally by reference 13 and an anchor mechanism indicated generally by reference 12. Expander mechanism 11 is mounted towards a leading end 16 of tube 25 whilst retainer mechanism 13 and anchor mechanism 12 are positioned towards a trailing end 41 of tube 25. In particular, anchor mechanism 12 projects rearwardly from tube 25 and is positioned at and extends from an open end of bore 36 adjacent a surface 35 of the rock strata 15 that surrounds the bore open end.

According to the specific implementation, expander mechanism 11 is formed from a pair of cooperating wedges 14, 17. A first wedge 14 is formed generally as a collar having an internal bore with radially inwardly facing threads to engage and cooperate with corresponding threads 20 provided at a first end 21 of an elongate bar 22 that extends axially through tube 25 from tube trailing end 41 to tube leading end 16. First wedge 14 is accordingly axially adjustable at bar 22 via the respective threads. Second wedge 17 is mounted rigidly to an internal facing surface 26 of tube 25 at a position towards tube leading end 16. The first and second wedges 14, 17 each comprise a respective engaging surface 18, 19 aligned transverse to axis 52. Accordingly, by linear axial adjustment of first wedge 14 along bar 22, engaging surface 18 of first wedge 14 abuts engaging surface 19 of second wedge 17 so as to force the first wedge 14 radially outward from axis 52 and against tube internal surface 26. The radial expansion of expander mechanism 11 acts to force and deform tube 25 radially outward against the internal facing surface of bore 36 to lock the friction bolt assembly 10 within the bore 36.

Linear axial movement of first wedge 14 is provided by anchor mechanism 12 that includes a nut 32 rigidly mounted or bonded to a second end 40 of bar 22. Accordingly, rotation of nut 32 about axis 52 provides the corresponding rotation of threads 20 that, in turn, pulls the first wedge 14 towards tube trailing end 41 to provide the radial expansion force. Anchor mechanism 12 further includes a washer 31 (alternatively termed a gasket) having a central aperture 33 to sit about and around bar 22 at second end 40. Gasket 31 is formed non-integrally with nut 32, tube 25 and other components of the bolt assembly 10 so as to be an independent component. Gasket 31 projects radially outward from bar 22 and tube 25 such that an abutment surface 37 that is orientated generally axially towards tube leading end 16 extends radially outward beyond a radially external facing surface 54 of tube 25. According to the specific implementation, gasket 31 and surface 37 extend radially outward beyond tube external surface 54 by a distance that is approximately equal to or greater than a corresponding radial distance by which gasket 31 projects radially inward from tube internal surface 26 towards bar 22 that is centred on axis 52. As will be appreciated, the distance by the gasket 31 extends radially beyond the tube wall may be varied and selected to suit specific applications. Accordingly, gasket 31 provides a radially outward extending flange at the tube trailing end 41 and bar second end 40. Gasket 31 accordingly projects radially outward beyond the diameter of bore 36 (formed within the rock strata 15) such that at least a radial outer region of abutment surface 37 is capable of being braced, either directly or indirectly, against the rock strata surface 35 that surrounds radially the bore open end.

According to the specific implementation, the friction rock bolt assembly 10 includes a rock plate indicated generally by reference 30 that is formed as a profiled generally annular gasket having a radially outer portion and a corresponding radially inner portion. The radially outer portion includes a generally annular (or in other instances rectangular) abutment surface 47 configured to sit against the rock strata surface 35 whilst the inner portion terminates as an annular edge 48 that defines a central hole having a diameter slightly greater than a diameter of tube 25 but less than a corresponding diameter of gasket 31. In particular, the radially inner edge 48 of rock plate 30 is configured to abut gasket surface 37 such that gasket 31 is braced against the rock strata surface 35 via rock plate 30. Accordingly, gasket 31 projects radially outward from tube 25 to provide an appropriate radial overlap between the radially inner portion of rock plate 30 and a radially outer portion of gasket 31 in turn allowing gasket 31 to be braced against rock plate 30 which is, in turn, braced against rock strata surface 35. According to the specific implementation, gasket 31 projects radially outward beyond tube 25 so as to represent a radially outermost region, part or component of rock bolt assembly 10 at the tube trailing end 41 that is not permanently mechanically attached to tube 25. Tube trailing end 41 according to the specific implementation, is devoid of a ring or collar positioned externally at tube external surface 54 that may otherwise obstruct or obscure gasket abutment surface 37 and impede or inhibit the abutted mating with the radially inner edge 48 of rock plate 30. According to further embodiments, gasket 31 may be configured to sit directly against the rock strata 15 via respective abutment between abutment surface 37 and rock surface 35.

Friction bolt assembly 10 is specifically arranged to prevent ejection under load of portions of the assembly should the bar 22 fail (i.e. break) that would otherwise represent a significant safety risk to workers and cause damage to equipment in the vicinity of the assembly 10. Failure of bar 22 may result from a tensile load created between the anchor mechanism 12 and the expander mechanism 11 exclusively or in addition to shear forces that act on the friction bolt assembly 10 from the rock strata 15. Tensile loading of bar 22 may also result from longitudinal shift of the rock strata 15 that in turn forces rearwardly the rock plate 30, gasket 31 and nut 32. Should bar 22 break, the retainer mechanism 13 (mounted at the trailing end of tube 25) is configured to catch the trailing end of the bar 22 that is disconnected from the first end 21 and the expander mechanism 11 and to prevent this length portion of the bar 22 from being ejected and separated from the assembly 10. The retainer mechanism 13 is further advantageous to also prevent all or part of the anchor mechanism 12 from being ejected from the assembly 10 should the bar 22 fail. The retainer mechanism 13 acts by providing cooperated frictional engagement between a component provided at the tube 25 and the bar 22 or a component secured to bar 22. According the specific implementation, retainer mechanism 13 includes a sustainer indicated generally by reference 29 that is secured to tube 25 and at least one engager in the form of ribs 23 that projects radially outward from bar 22 over a length portion of the bar between threads 20 (positioned generally at bar first end 21) and a rearward portion 24 of bar 22 extending from second end 40. Bar rearward portion 24 is devoid of ribs 23 so as to define a generally smooth cylindrical bar section. Retainer mechanism 13 further includes a restrainer collar 27 having a central bore 34 dimensioned to receive the rearward portion 24 of bar 22 with restrainer 27 including a diameter so as to extend radially between bar portion 24 and the inner surface 26 at tube 25 so as to maintain the bar 22 centred at all times including during handling, in use and in the event of failure of the bar 22.

Figure 1B:
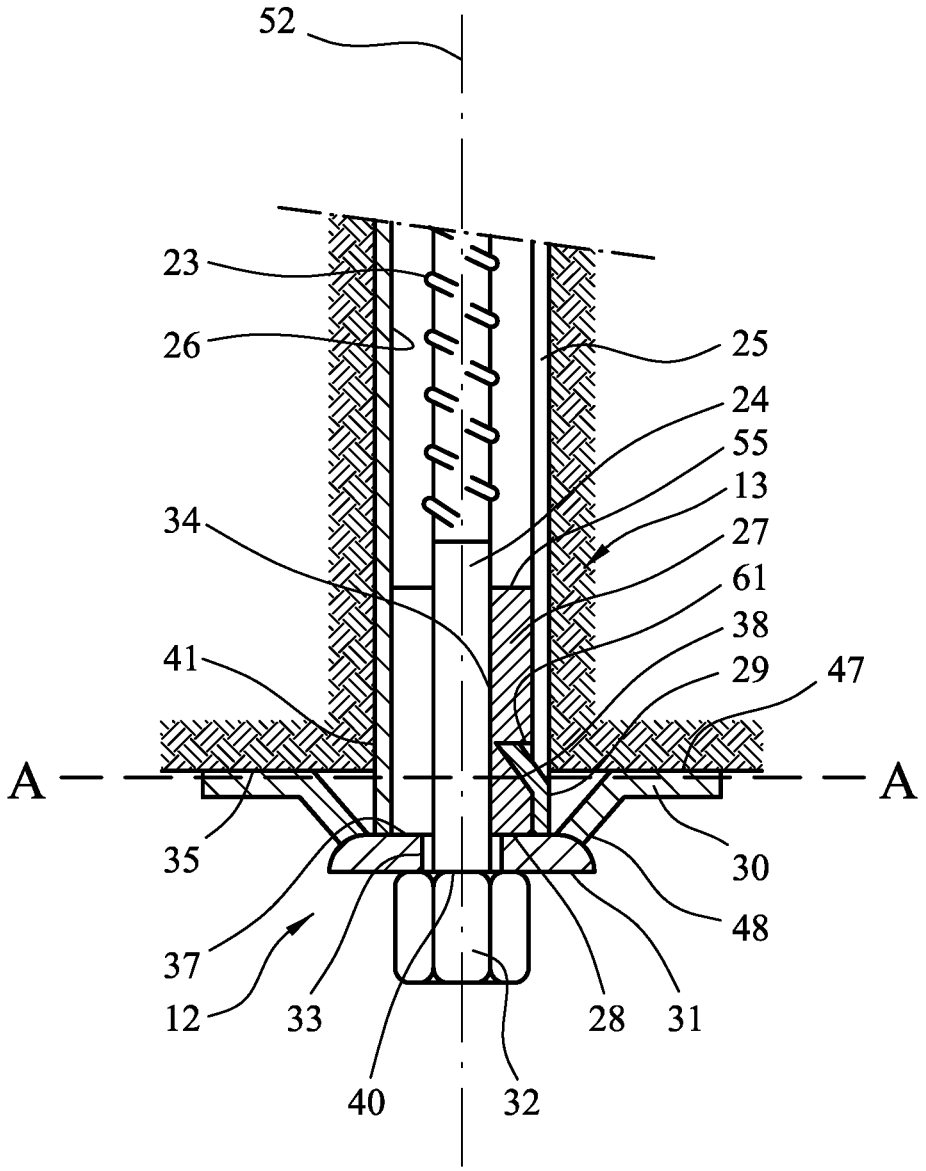
FIG. 1B is a partial cross-sectional view of a friction rock bolt assembly according to a further embodiment configured for anchored mounting within a bore formed in rock strata according to a specific implementation.
Figure 3:
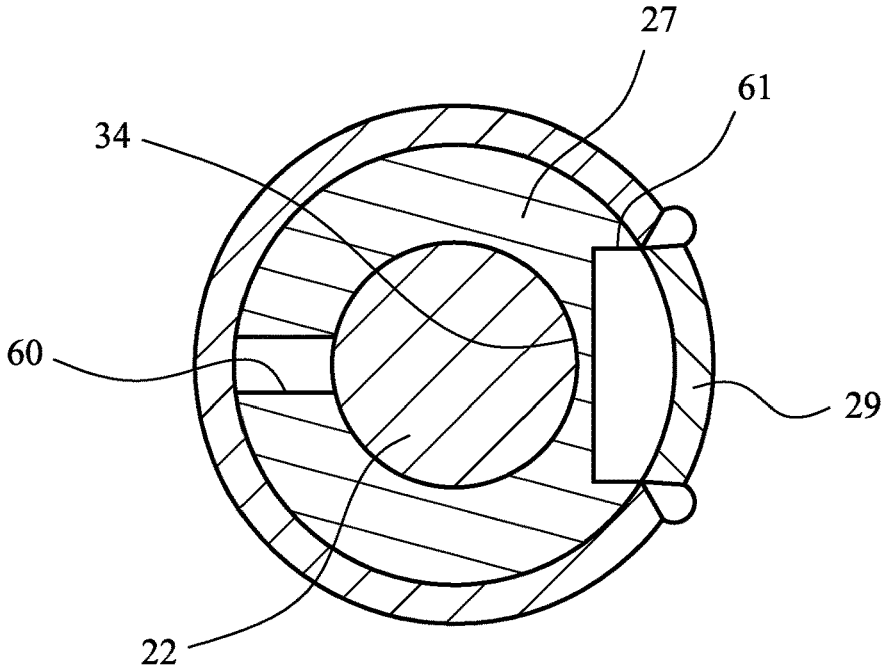
FIG. 3 is a cross-sectional view through A-A of the rock bolt assembly of FIG. 1B.

A slight variation of the embodiment of FIG. 1A is illustrated in FIG. 1B and FIG. 3. According to the further embodiment, restrainer 27 (being formed as a collar) includes a slot 60 extending axially from annular rearward facing surface 28 to an annular forward facing surface 55. Slot 60 is dimensioned so as to allow radial expansion and compression of the collar-like restrainer 27. In particular, collar 27 is capable of expanding radially as bar 22 is displaced axially rearward and at least one of the axially rearward ribs 23 is forced into restrainer 27 causing it to expand radially against the internal facing surface 26 of tube 25. Such a configuration is advantageous to distribute the loading forces transmitted through bar 22 to reduce the likelihood (or magnitude) of bar elongation. Such an arrangement is further advantageous to avoid cooperating wedges 14, 17 from passing axially past one another. The radial expansion of restrainer 27 acts to increase the frictional contact between external facing surface 54 of tube 25 and rock strata 15 that, in turn and in combination with wedges 14, 17, anchors securely the friction bolt assembly 10 within the rock strata 15. According to the further embodiment of FIGS. 1B and 3, restrainer 27 includes a radially inward recessed notch 61 so as to cooperate with sustainer 29 as described further below.

Figure 2:
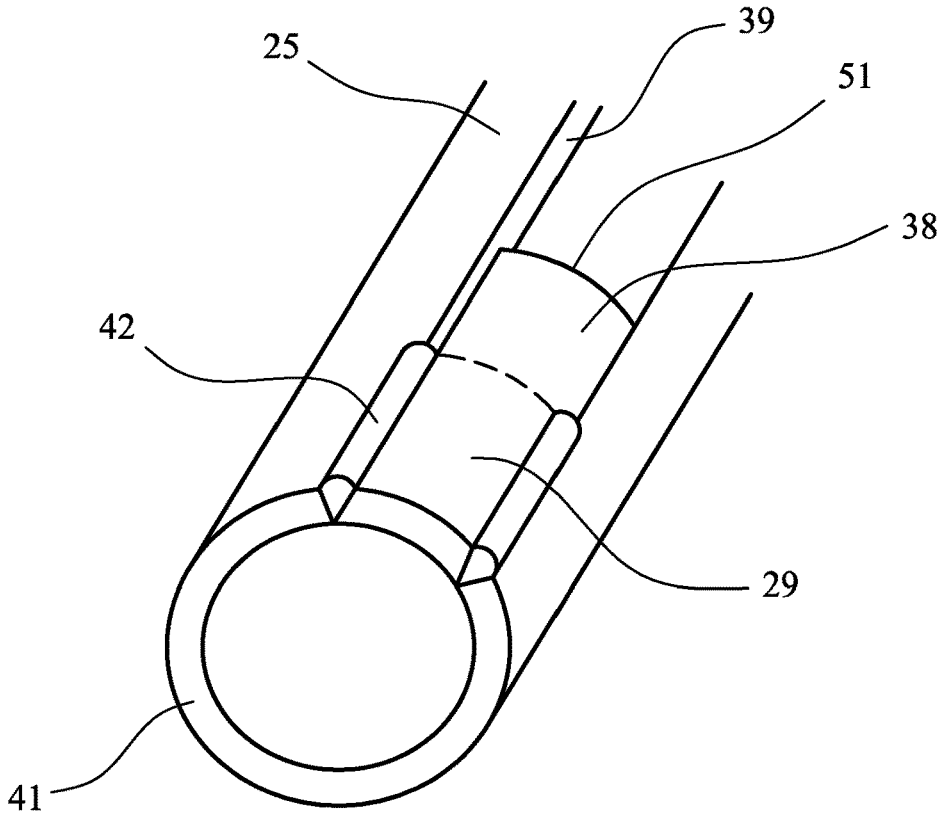
FIG. 2 is a perspective view of a trailing end of a tube part of the rock bolt assembly of FIG. 1A.

Referring to FIGS. 1A and 2, tube 25 includes a generally cylindrical shape profile having a longitudinal split 39 to allow tube to radially contract that is advantageous during insertion of the assembly 10 within the bore 36 and to radially expand to facilitate the radial expansion of the expander mechanism 11 towards leading end 16 of tube 25. According to the specific implementation, sustainer 29 is formed as a generally rectangular tab having a width corresponding approximately to a width of split 39 so as to bridge the split 39 at the tube trailing end 41. Tab 29 is secured to the opposed edges that define split 39 via a weld material 42. An axially forward portion 38 of tab 29 is not secured to the split edges and accordingly may be bent radially inward so as to project radially within the bore of tube 25 towards central axis 52 and bar 22 as a final stage of the assembly of the rock bolt 10. According to the specific implementation, a radial length of portion 38 is approximately equal to half of the radial distance between the tube inner facing surface 26 and the external facing surface of bar 22 at the rearward portion 24. A leading edge 51 of tab 29 is positioned to abut against a annular rearward facing surface 28 of restrainer collar 27 mounted about bar rearward portion 24. Accordingly, restrainer 27 is prevented from axial displacement beyond the axial position of a tab leading edge 51. The retainer mechanism 13, including sustainer 29, restrainer 27 and engager 23 is adapted such that if bar 22 breaks longitudinally, the rearward portion of the bar 22 and the anchor mechanism 12 are retained in coupled relationship to tube 25 via frictional engagement between engager 23, restrainer 27 and sustainer 29. In particular, due to the tensile load through bar 22 in use, should the bar 22 break, the rearward portion would travel rearwardly with significant momentum. This rearward travel is arrested by an axially rearwardmost rib 23 abutting the annular forward facing surface 55 of restrainer 27. The restrainer 27 is, in turn, prevented from axial rearward travel by frictional contact between the leading edge 51 of sustainer 29 (once the forward portion 38 of tab 29 is bent radially inward) and the rearward facing annular surface 28 of restrainer collar 27. According to the embodiment of FIGS. 1B and 3, axially forward portion 38 of tab 29 is configured to be received within notch 61 so as to axially retain restrainer collar 27. In particular, collar 27 is prevented from movement axially rearward as bar 22 is displaced axially rearward and the ribs 23 are forced under and within restrainer collar 27. This contact between ribs 23 and collar 27 in turn provides radial expansion of restrainer 27 and the additional axial locking of the assembly 10 at the rock strata 15.

The subject invention is advantageous in that the retainer mechanism 13 is placed under load only in the event of bar 22 breaking and in particular it does not require tube 25 being placed under tension to achieve the retaining lock of the fractured portion of bar 22. This is achieved, in part, by the cooperative configuration of the anchor mechanism 12 that is not secured under load to the trailing end 41 of tube so as to avoid the likelihood of fracture and failure of the tube 25 at the region of the anchor mechanism 12. In particular, the force transmission pathway through the assembly 10 includes tensile loading of bar 22 by the anchor mechanism 12, including nut 32, gasket 31 and rock plate 30 where these latter two components are, in turn, placed under compression by tightened nut 32 that also by rotation, braces first wedge 14 against second wedge 17. Accordingly, tube 25 is placed under mild axial compression. Such an arrangement is advantageous to avoid stress concentrations at the region of sustainer 29 that may otherwise lead to detachment of the sustainer from tube 25 and failure of the retainer mechanism 13. This arrangement is further advantageous to allow the unhindered radial expansion of the tube 25 (via mechanism 11) that may otherwise be restricted if the tube was placed under tensile load. The embodiment according to FIGS. 1 to 3 is further advantageous in that the sustainer tab 29 bridging the tube longitudinal split 39 reinforces the tube 25 at the trailing end 41. Radial reinforcement is also achieved via the restrainer collar 27 that provides a radial bridge and reinforcement between tube 25 and bar 22. The desired force transmission pathway through assembly 10 is achieved, in part, by the mounting of rock plate 30 exclusively at the gasket 31 that is not mechanically attached to tube 25.

In use, nut 32 is rotated during initial loading of the assembly 10 into the bore 36, such that gasket 31 and in particular a forward facing annular surface 37 is forced against the annular trailing end 41 of tube 25 so as to brace the gasket 31 against tube 25 and the rock plate 30 against rock surface 35. Should the bar 22 break longitudinally, the rearward portion of the assembly 10 including bar portion 24 and anchor mechanism 12 would displace axially rearward by a distance corresponding to the axial distance of bar 22 between restrainer forward facing surface 55 and the axially rearwardmost rib 23. The axial length of the smooth (non-ribbed) portion of bar 22 is configured such that the anchor mechanism 12 and bar rearward portion 24 separates from rock surface 35 by a distance that may be observed by personnel to identify that the friction bolt assembly 10 has failed and requires maintenance or replacement. Preferably, an axial distance between a rearwardmost rib 23 and restrainer surface 55 is 20 to 40 mm Restrainer 27 is also advantageous to support positionally bar 22 and to prevent the bar 22 moving up and down during transport and handling. As will be appreciated, sustainer tab 29 may comprise any shape profile and configuration secured to tube 25 to provide a radially extending abutment to contact and inhibit axial rearward movement of restrainer 27. According to further implementations, the sustainer 29 may be formed integrally with tube 25 and may comprise one or a plurality of regions of tube 25 that are deformed radially inward such as crimped regions, punctured or splintered portions of tube 25.

Figure 4:
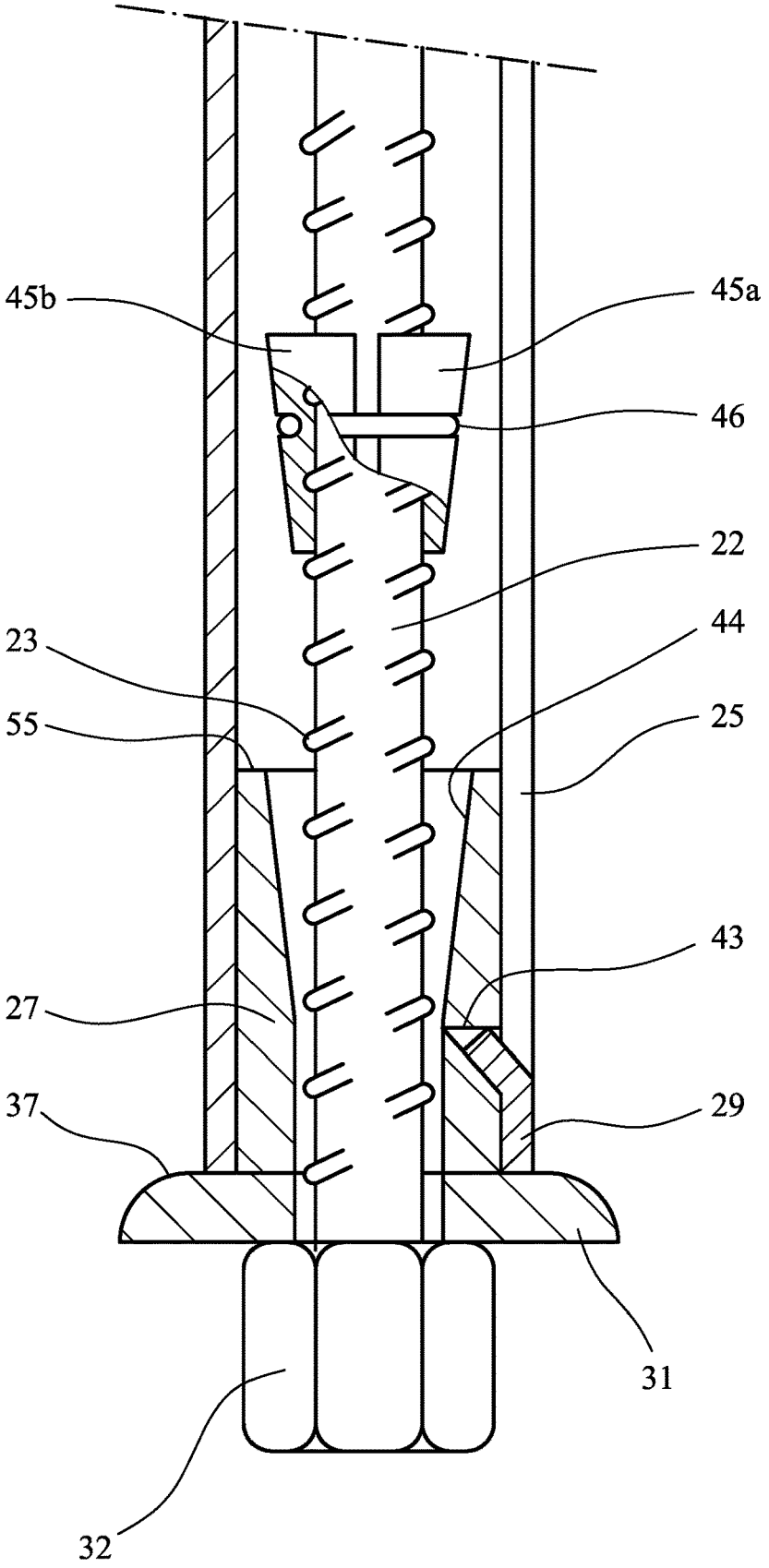
FIG. 4 is a partial cross-sectional view of a trailing end portion of a friction rock bolt assembly according to a further specific implementation.

FIG. 4 illustrate a further embodiment of the assembly 10. According to the further embodiment, ribs 23 are not removed from a rearward portion 24 of bar 22 and instead extend substantially the full axial length of bar 22 between thread 20 and the bar rearward second end 40. The engager part of retainer mechanism 13 is formed at a two-part collar having a first half 45*a* and a second half 45*b* positioned opposed to one another about bar 22 and secured in position via a locking spring clip 46. In particular, each engager half 45*a*, 45*b* includes a circumferentially extending groove to mount and axially restrain spring clip 46 that provides radial compression to each engager half 45*a*, 45*b* to securely mount and clamp engager 45*a*, 45*b* at bar 22. Each engager half 45*a*, 45*b* may be formed from a plastic material that is deformable via clamping engagement onto ribs 23 to further enhance the axial lock of the engager 45*a*, 45*b* at bar 22. Alternatively, one or both engager halves 45*a*, 45*b* may comprise grooves or portions recessed into the radially inward facing surface of the respective half 45*a*, 45*b* to mate with the bar ribs 23 and increase the frictional lock at the bar 22.

According to the further embodiment, restrainer collar 27 includes a generally cylindrical external facing surface. Collar 27 also includes a radially inward facing surface 44 having a length portion that is generally conical such that a diameter of cone surface 44 is greatest at the axially forwardmost end of collar 27 corresponding to the forward facing annular surface 55. The transverse orientation of conical surface 44 corresponds to the orientation of a radially external facing surface of engager 45*a*, 45*b* that is also generally conical. Accordingly, should bar 22 break at a region axially forward of engager 45*a*, 45*b*, the engager 45*a*, 45*b* would travel axially rearward so as to contact the restrainer cone surface 44 to axially lock and retain the rearward portion of bar 22 at restrainer 27. The restrainer 27 is accordingly held at tube 25 via frictional engagement with the sustainer 29. According to the further embodiment of FIG. 4, restrainer 27 includes a radially inward recessed notch 43 into which is received the forward portion 38 and leading edge 51 of sustainer 29 so as to axially retain collar 27 at tube 25.

Figure 5:
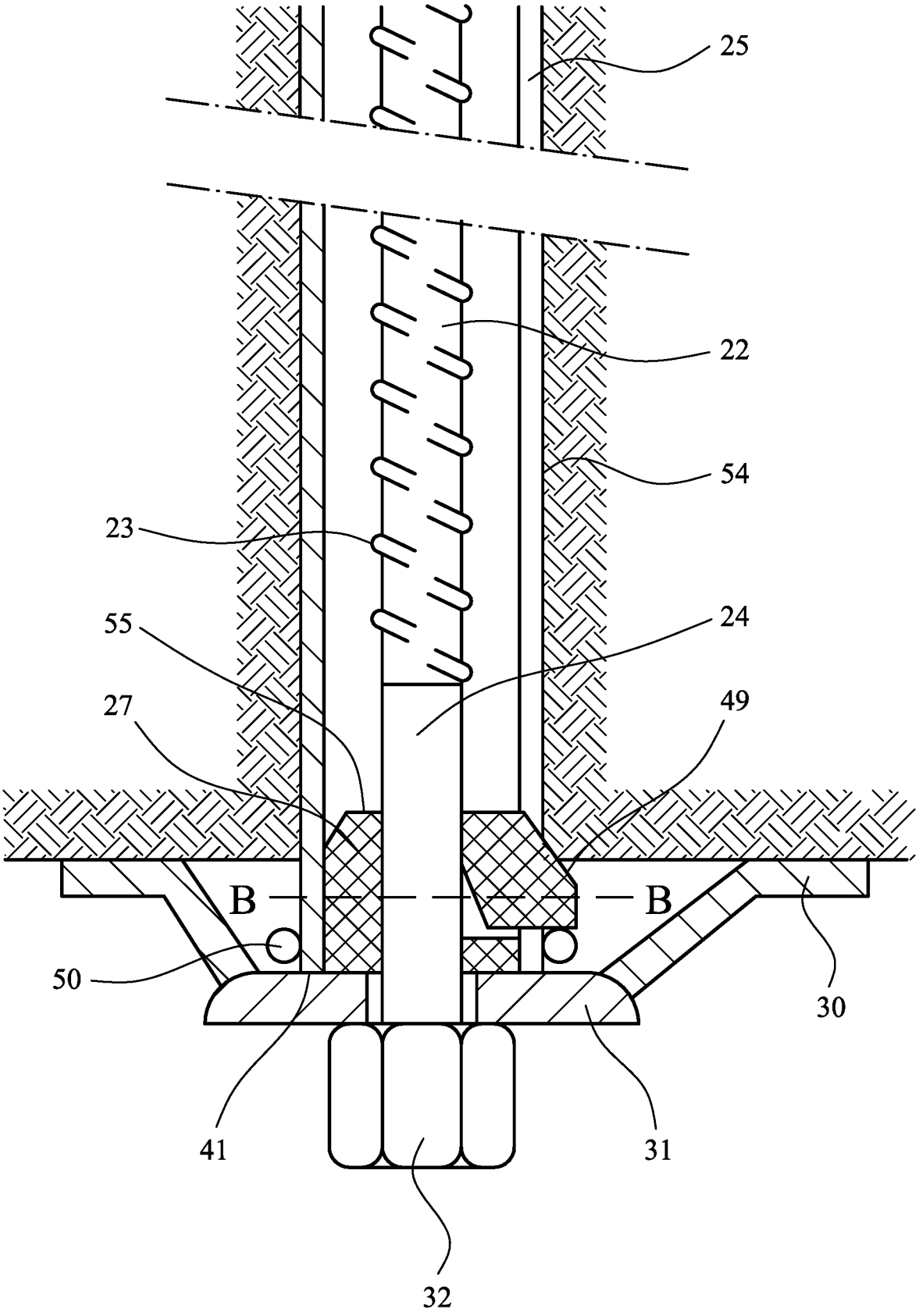
FIG. 5 is a partial cross-sectional view of a trailing end portion of a friction rock bolt assembly according to a further specific implementation.
Figure 6:
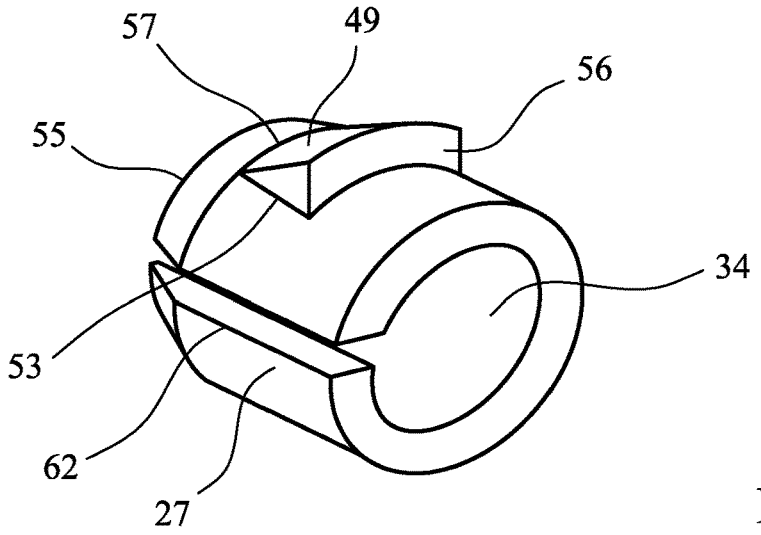
FIG. 6 is a perspective view of a restrainer part of the rock bolt assembly of FIG. 5.
Figure 7:
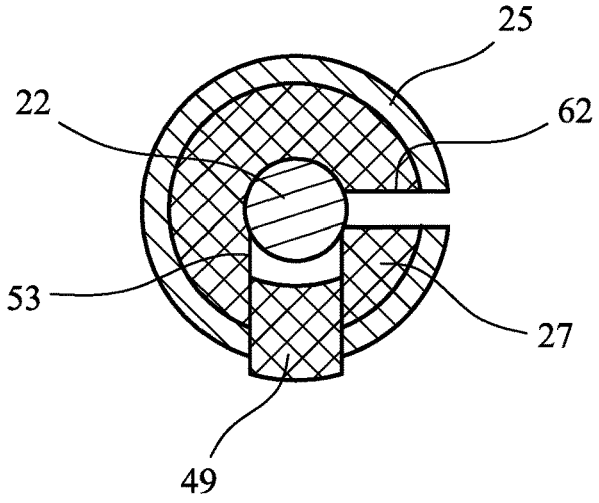
FIG. 7 is a cross-sectional view through B-B of the rock bolt assembly of FIG. 5.

FIGS. 5 to 7 illustrate a yet further embodiment of the friction assembly of FIG. 1. According to the further embodiment, restrainer collar 27 includes a generally cylindrical sleeve having a central bore 34 dimensioned for close fit in contact over and about the smooth rearward portion 24 of bar 22. A compressible barb 49 projects radially outward from a radially external surface of restrainer 27. Barb 49 projects radially outward from the main cylindrical collar of restrainer 27 by a distance approximately equal to a wall thickness of the cylindrical collar 27. Barb 49 is secured to collar 27 at a first hinging end 57 so as to be capable of radial displacement within a pocket 53 formed within a wall of restrainer collar 27. Restrainer 27 includes an elongate slot 62 extending the full axial length of restrainer 27. Slot 62 is configured to allow radial expansion and compression of the collar 27 and in particular to accommodate insertion of ribs 23 within collar 27 as bar 22 is displaced axially rearward during initial installation and as wedge 14 is moved axially relative to wedge 17. During initial loading of the restrainer collar 27 into tube 27, barb 49 is capable of compressing radially into collar 27 as it is forced into the interior of tube 25. According to a further embodiment, tube 25 also includes the longitudinal split 39 that extends the full axial length between leading and trailing ends 16, 41. A ring 50 is secured by a weld material to tube outer surface 54 at tube trailing end 41. Accordingly, as collar 27 is inserted within tube 25, barb 49 compresses radially into pocket 53 when passing under ring 50. Once barb 49 is axially clear of ring 50, it expands radially from pocket 53 into the split 39. Accordingly, an axially rearward end 56 of barb 49 is configured to abut ring 50 and axially lock collar 27 at tube 25 to prevent axially rearward displacement. As with the embodiment of FIGS. 1 to 3, the annular forward facing surface 55 of collar 27 is configured to be engaged by an axially rearwardmost rib 23 should bar 22 break. The bar rearward portion 24 and collar 27 are locked and prevented from axial detachment from tube 25 via frictional contact between barb rearward end 56 and ring 50.

Figure 8:
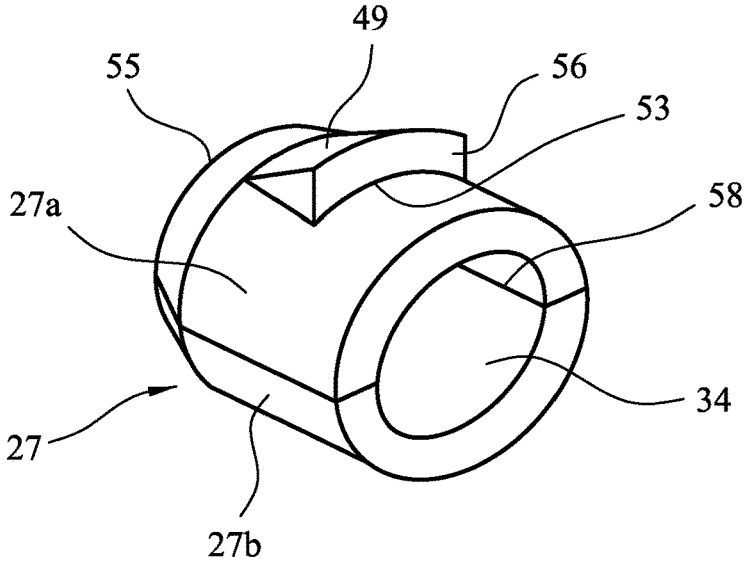
FIG. 8 is a further specific implementation of the restrainer part of FIG. 6 formed as a two-piece component.

A further specific implementation of the embodiment of FIGS. 5 to 7 is illustrated in FIG. 8 taking the majority of the features and components as discussed. According to the further embodiment, barb 49 is rigidly formed at restrainer 27 with the main restrainer body being formed from a first half 27*a* and a second half 27*b*. That is, restrainer 27 is divided axially into two halves. Accordingly, to assemble the retainer mechanism 13, restrainer first half 27*a* is inserted into the interior of tube 25 so as to align barb 49 into split 39 axially beyond ring 50. The second half 27*b* of restrainer 27 is then inserted to mate the lengthwise extending edges 58 of each half 27*a*, 27*b* to form the generally cylindrical restrainer 27.

Figure 9A:
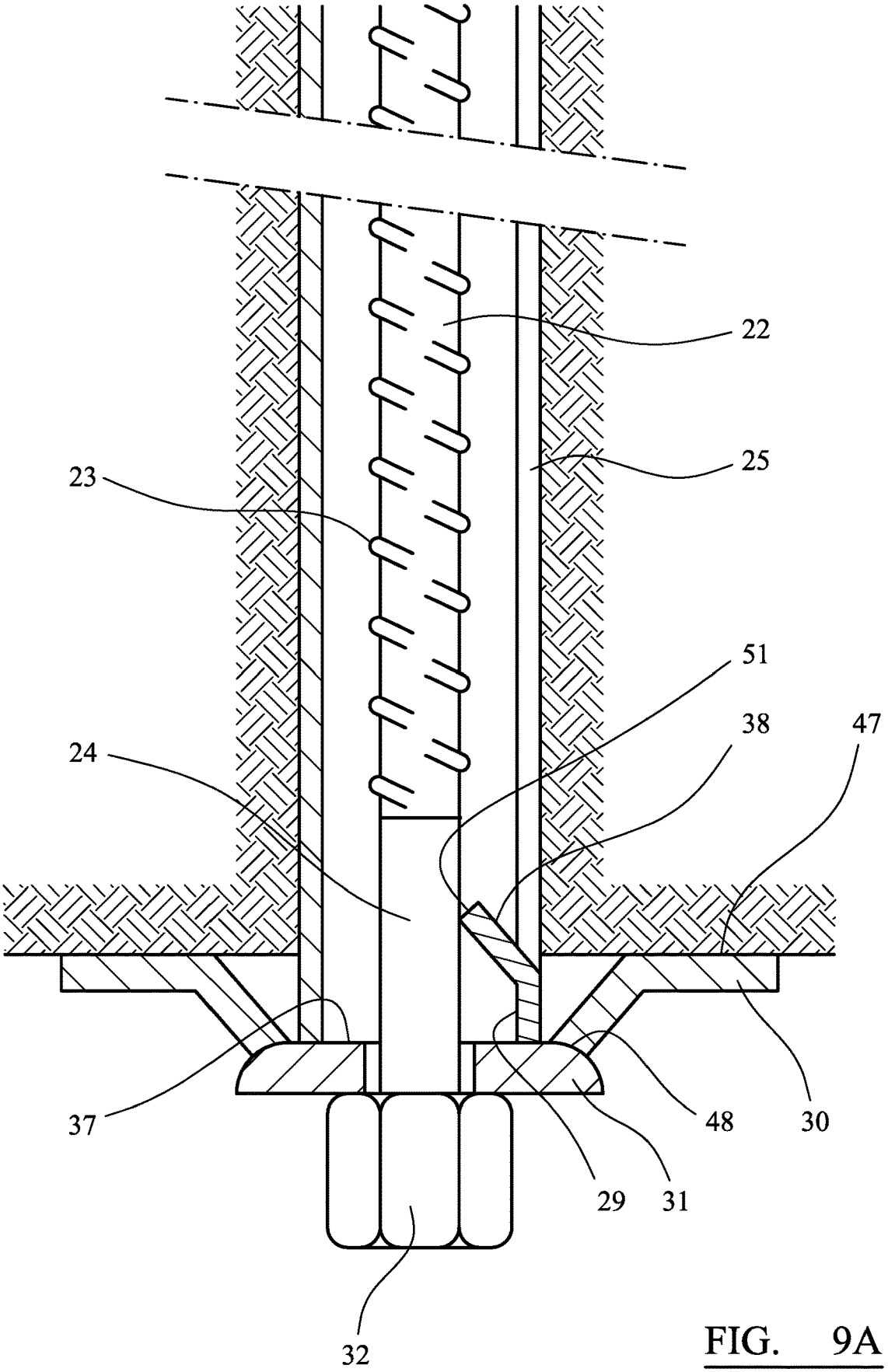
FIG. 9A is a partial cross-sectional view of a trailing end portion of a friction rock bolt assembly according to a further specific implementation.

A further embodiment of the friction bolt assembly 10 is illustrated in FIG. 9A according to a further simplified construction. According to the further embodiment, the assembly 10 is devoid of an intermediate restrainer 27 and frictional engagement is achieved by the direct frictional engaging contact between an axially rewardmost rib 23 and the leading edge 51 of sustainer tab 29. That is, the forward portion 38 of tab 29 includes a radial length greater than the corresponding length of the portion 38 of the embodiment of FIGS. 1 to 5 so as to extend radially from the tube inner surface 25 to contact against the external surface of tube rear portion 24. The embodiment of FIG. 9 may also comprise at least one centering component (not shown) positioned against or about the bar 22 so as to maintain the bar 22 at axis 52 should the bar 22 break. The centering component may be formed as a collar positioned axially at a region at or close to the rearwardmost rib 23. Alternatively the centering component may be formed as an axial extension of gasket 31 that extends within the tube interior to at least partially surround or abut the bar 22. Accordingly, should bar 22 break, the length portion 24 is capable of sliding against tab leading edge 51 until edge 51 contacts rib 23 so as to prevent further axial movement of the bar 22 relative to tube 25.

Figure 9B:
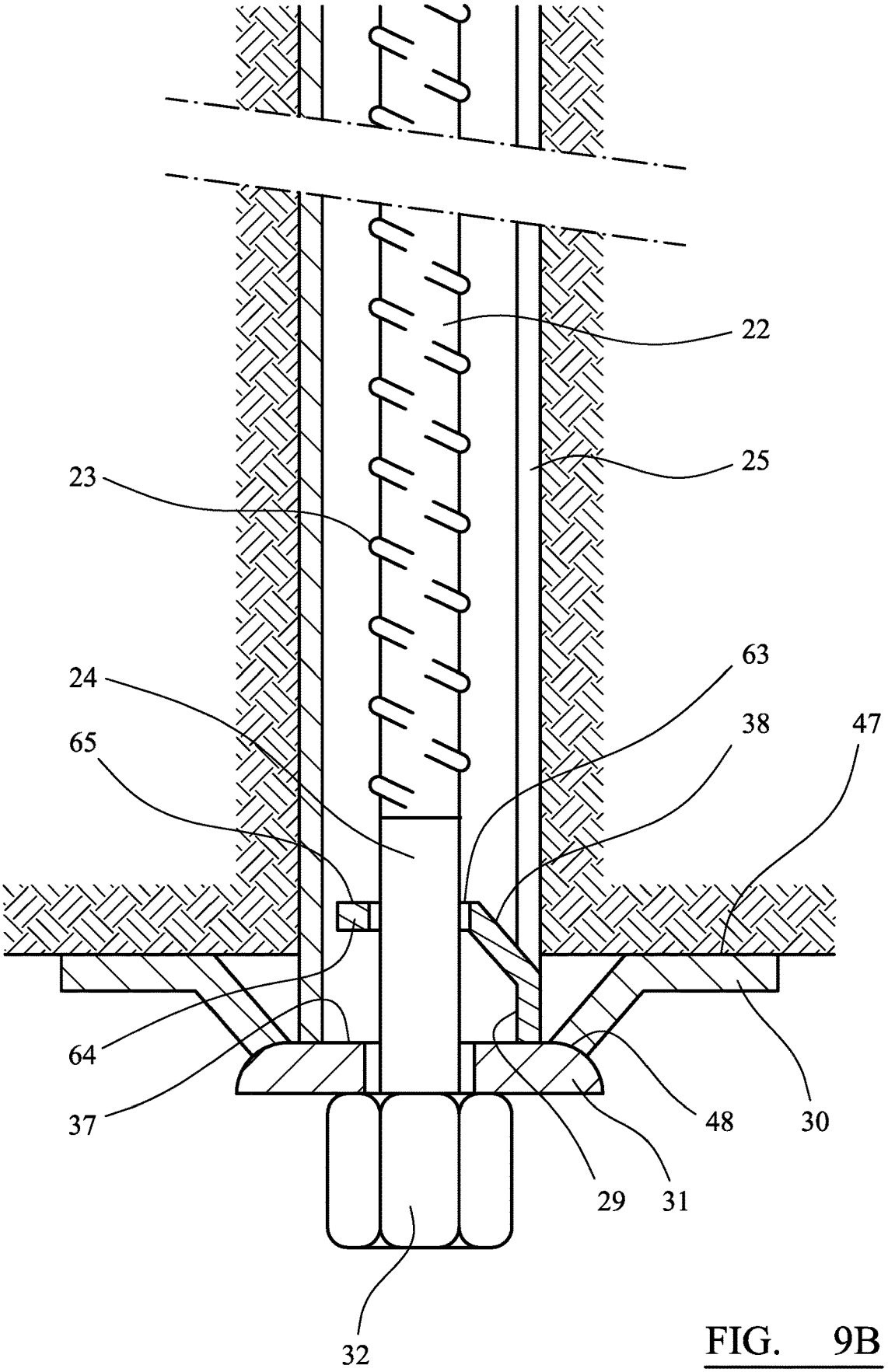
FIG. 9B is a partial cross-sectional view of a trailing end portion of a friction rock bolt assembly according to a further specific implementation.

A further embodiment of the friction bolt assembly 10 is illustrated with reference to FIG. 9B. FIG. 9B corresponds to the arrangement of FIG. 9A but differs in that tab 29 is provided with a ring 64 through which bar 22 is inserted. In particular, ring 64 includes a bore 63 being slightly greater than a diameter of bar 22 so as to allow bar 22 to slide axially within ring 64. However, bore 63 is dimensioned so as to be smaller than bar 22 at the ribbed section such that as bar 22 is displaced axially rearward, an axially rearwardmost rib 23 (or ribs 23) of bar engages a forward facing surface 65 of ring 64 and prevents further axial rearward movement of bar 22. As described, such a configuration is advantageous to prevent ejection of bar 22 (should the bar 22 break at any position within the ribbed section) and also to prevent significant bar elongation.

According to the further embodiments of FIGS. 4 to 9B, the anchor mechanism 12 is as described with reference to FIG. 1 in which the rock plate 30 is braced against the rock surface 35 via contact with the gasket 31 that is not secured to tube 25 and is in particular braced against tube trailing end 41 via nut 32.

According to further embodiments, the sustainer of the retainer mechanism 13 may be formed as an annular ring or abutment projecting radially from tube internal surface 26 at tube trailing end 41. A ring or projection at this region is also configured to inhibit the axially rearward movement of restrainer 27. However, as with the earlier embodiments, the sustainer is secured to the tube 25 such that the retainer mechanism 13 is configured to act between tube 25 and bar 22.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

What is claimed is:

1. A friction bolt assembly arranged to frictionally engage an internal surface of a bore formed in rock strata, the assembly comprising:

an elongate tube having a leading end and a trailing end;

an expander mechanism located towards or at the leading end of the tube and arranged to apply a radial expansion force to the tube to secure the assembly to the rock strata;

an elongate bar or cable extending longitudinally within the tube and connected at or towards a first end to the expander mechanism;

a retainer mechanism acting between the tube and the bar or cable, the retainer mechanism including a sustainer attached at or towards the trailing end of the tube and an engager, wherein the engager is configured to engage radially the sustainer to prevent ejection of at least a length portion of the bar or cable from the assembly should the bar or cable break; and an anchor mechanism positioned at or towards the trailing end of the tube, the anchor mechanism including a fixing mountable at or towards a second end of the bar or cable and configured to brace against the trailing end of the tube that by adjustment creates tension in the bar or cable to act on the expander mechanism to create the radial expansion force, wherein at least a part of the fixing projects radially outward beyond the tube or a component attached to an external region of the tube to be braced against the rock strata at a region around an external end of the bore.

2. The assembly as claimed in claim 1, wherein the fixing includes a nut and a flange extending radially outward beyond the tube, the flange being configured to be braced against the rock strata.

3. The assembly as claimed in claim 2, wherein the flange and the nut are formed non-integrally, the nut is coupled directly to the bar or cable; and the flange is positioned axially between the nut and the trailing end of the tube.

4. The assembly as claimed in claim 2, wherein the flange includes an abutment extending radially outward from the tube and having at least a portion facing generally towards the leading end of the tube, the abutment surface being arranged to be engaged by a rock plate to extend radially outward from the flange and to brace against the rock strata at the region around the external end of the bore.

5. The assembly as claimed in claim 4, wherein a distance by which the flange extends radially outward from the tube is approximately equal to or greater than a distance by which the flange extends radially inward between the tube and the bar or cable.

6. The assembly as claimed in claim 4, wherein a distance by which the flange extends radially outward from the tube is greater than half a radial thickness of the bar or cable.

7. The assembly as claimed in claim 2, further comprising a rock plate arranged to abut against and extend radially outward from the flange to brace against the rock strata at the region around the external end of the bore.

8. The assembly as claimed in claim 1, wherein the retainer mechanism further includes a restrainer positioned radially between the bar and an inner surface of the tube, the engager being configured to engage radially the restrainer and the restrainer is configured to engage radially the sustainer to prevent ejection of the bar or cable from the assembly should the bar or cable break.

9. The assembly as claimed in claim 8, wherein the restrainer is a collar having a central bore arranged to receive the bar or cable.

10. The assembly as claimed in claim 9, wherein the restrainer is formed as a single component.

11. The assembly as claimed in claim 9, wherein the restrainer is formed as a component having two parts, the two parts being divided axially.

12. The assembly as claimed in claim 8, wherein the restrainer includes a radially inward facing conical or tapered surface arranged to be engaged by the engager.

13. The assembly as claimed in claim 8, wherein the restrainer includes a notch formed in a radially outward facing surface of the restrainer to receive radially at least a part of the sustainer.

14. The assembly as claimed in claim 8, wherein the restrainer includes a barb projecting radially outward beyond the tube to engage the sustainer mounted radially externally at the tube.

15. The assembly as claimed in claim 8, wherein the restrainer is formed as a single component which is split longitudinally to enable the restrainer to radially expand and contract.

16. The assembly as claimed in claim 8, wherein the engager includes ribs protecting radially outward from the bar or cable.

17. The assembly as claimed in claim 8, wherein the engager includes a wedge or ferrule attached to the bar or cable.

18. The assembly as claimed in claim 8, wherein the sustainer includes a tab projecting radially inward from the tube.

19. The assembly as claimed in claim 9, wherein the sustainer includes a band or ring attached to the tube and engageable radially with at least part of the engager or the restrainer.

20. The assembly as claimed in claim 1, wherein the tube includes a split extending longitudinally and arranged for radial expansion and contraction.

21. The assembly as claimed in claim 1, wherein the sustainer includes a bridge tab secured across the split at or towards the trailing end of the tube, the bridge tab having a portion that is bent radially inward to extend within the tube towards the bar of cable.

22. A friction bolt assembly arranged to frictionally engage an internal surface of a bore formed in rock strata, the assembly comprising:

an elongate tube having a leading end and a trailing end;

an expander mechanism located towards or at the leading end of the tube and arranged to apply a radial expansion force to the tube to secure the assembly to the rock strata;

an elongate bar or cable extending longitudinally within the tube and connected at or towards a first end to the expander mechanism;

a retainer mechanism acting between the tube and the bar or cable, the retainer mechanism including a sustainer attached at or towards the trailing end of the tube, the retainer mechanism being configured to prevent ejection of at least a length portion of the bar or cable from the assembly; and an anchor mechanism positioned at or towards the trailing end of the tube, the anchor mechanism including a fixing mountable at or towards a second end of the bar or cable and configured to brace against the tube such that by adjustment creates tension in the bar or cable to act on the expander mechanism to create the radial expansion force, wherein at least a part of the fixing projects radially outward beyond the tube or a component attached to an external region of the tube to be braced against the rock strata at a region around an external end of the bore.

* * * * *